United States Patent [19]

Havrilla, Jr.

[11] Patent Number: 4,899,938

[45] Date of Patent: Feb. 13, 1990

[54] LIQUID SPRAY NOZZLE ADAPTER

[76] Inventor: John W. Havrilla, Jr., 2048 Eastlawn Ave., Akron, Ohio 44305

[21] Appl. No.: 113,499

[22] Filed: Oct. 28, 1987

[51] Int. Cl.[4] ..... B05B 1/28

[52] U.S. Cl. ..... 239/294; 239/301

[58] Field of Search ..... 239/292, 294, 300, 301, 239/416, 416.1, 416.4, 416.5, 417, 526, 527, 528

[56] References Cited

U.S. PATENT DOCUMENTS

| | | | |
|---|---|---|---|
| 1,661,150 | 2/1928 | Birkenmaier . | |
| 1,780,738 | 11/1930 | Beach . | |
| 1,990,823 | 2/1935 | Gustafsson | 299/140.1 |
| 2,029,423 | 2/1936 | Gustafsson | 299/140.1 |
| 2,070,696 | 2/1937 | Tracy | 299/140.1 |
| 2,544,123 | 3/1951 | Andersson | 299/141 |
| 4,171,096 | 10/1979 | Welsh | 239/291 |

*Primary Examiner*—Andres Kashnikow
*Assistant Examiner*—Michael J. Forman
*Attorney, Agent, or Firm*—Michael Sand Co., L.P.A.

[57] ABSTRACT

A nozzle adapter is removably mounted on the end of a liquid spray gun to provide a variety of spray patterns and to reduce or eliminate the atomization of the spray liquid. The nozzle adapter is formed by a liquid material discharge member which is removably mounted on the spray gun and an outer pressurized air adjustment member which is removably adjustably mounted on the discharge member. A cone-shaped nozzle of the discharge member projects outwardly through an air passageway formed in a front wall of the air adjustment member. A tubular stream of pressurized air is projected outwardly through the air passageway and surrounds a stream of liquid discharged through an opening in the nozzle tip. Adjustment of the tubular air pattern provides for various liquid spray patterns and varying amounts of atomization of the discharged liquid. The discharge member may alternatively be mounted on a spray gun without the air adjustment member mounted thereon. The nozzle of the discharge member extends outwardly from an annular wall formed with a plurality of air ports in a circular arrangement about the base of the nozzle and rearwardly of the liquid discharge opening in the nozzle tip. A thin stream of liquid emitted from the discharge opening is carried by the spaced stream of pressurized air from the air ports for deposit on an adjacent surface to provide a non-atomizing decorative spray pattern. No known prior art nozzle adapter achieves such a variety of spray patterns in as simple a manner.

10 Claims, 2 Drawing Sheets

FIG. 1
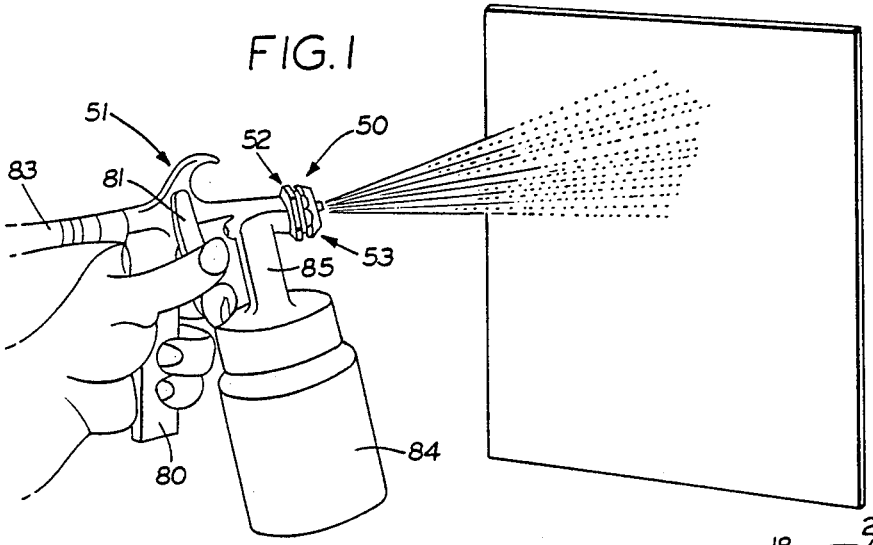
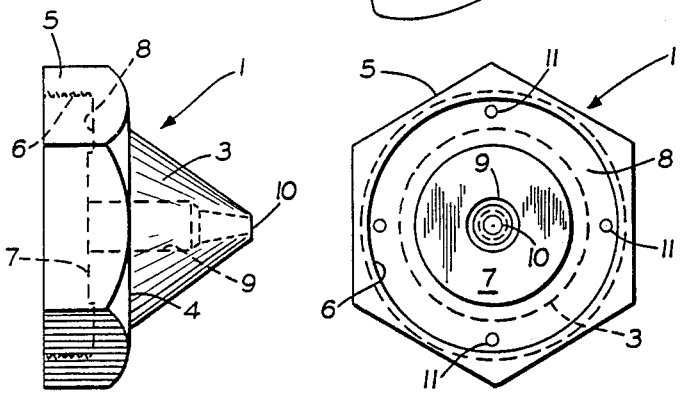
PRIOR ART
FIG. 2
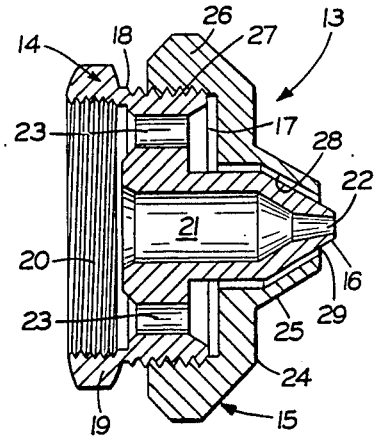
PRIOR ART
FIG. 3
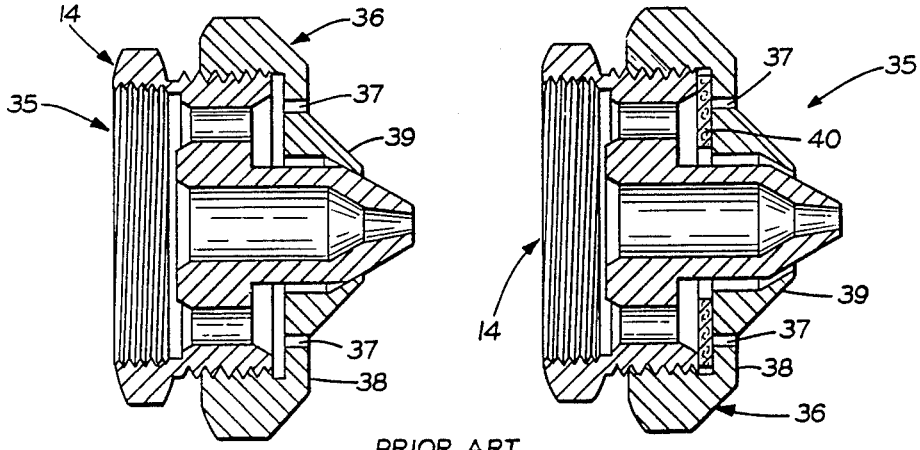
PRIOR ART
FIG. 4

LIQUID SPRAY NOZZLE ADAPTER

TECHNICAL FIELD

The invention relates to spraying devices and in particular to a nozzle adapted for mounting on the end of a spray gun for spraying of paint or other liquid coating material by compressed air. More particularly, the invention relates to a nozzle adapter which provides for various spray patterns and which substantially reduces or eliminates atomization of the sprayed liquid during a spraying operation.

BACKGROUND ART

Pressurized air-powered liquid sprayers, commonly referred to as spray guns, have been used for a considerable number of years for applying paint or other liquid material to a surface or object. These sprayers usually have a pistol grip handle and an outwardly extending spray barrel on which is attached a container for holding a supply of paint or other liquid. The gun is connected to a compressor or other source of pressurized air, whereby movement of a release valve will permit the air to flow through the gun and out of the discharge end thereof, drawing with it a predetermined quantity of liquid from the attached container. The air and liquid are mixed in various manners whereby the liquid particles are atomized by the pressurized air to create an evenly distributed pattern on the object being coated. Numerous types of spray nozzles have been developed for use with pressurized air spray guns for enhancing the atomization and paint pattern achieved thereby. In many of these prior art nozzles, the pressurized air streams are directed at various angles against the liquid stream as it is being discharged from the nozzle end. Examples of such prior art spray nozzles are shown in U.S. Pat. Nos. 1,990,823; 2,070,696 and 2,082,060. Examples of other known prior art spray nozzles and similar devices are disclosed in U.S. Pat. Nos. 1,661,150; 1,780,738; 2,029,423; 2,544,123; 3,685,741; 3,687,368;3,746,253; 3,876,150; 3,905,554; 4,171,091; 4,171,096; 4,343,433; 4,349,153; 4,361,285; 4,381,081; 4,385,728; 4,478,370; 4,501,394; 4,531,675; 4,544,100; 4,616,784.

One of the main purposes of these spray nozzles, as well as other prior art nozzles, is to atomize the liquid spray by directing the air against the stream of liquid. One problem is that atomization of the liquid, although providing in many instances a satisfactory spray pattern and coating, causes dried liquid particles to float in the air, which particles settle on surrounding furniture, floors, windows, etc., requiring complete coverage of the adjacent areas with cloths and other protective coverings. This atomized liquid, especially if paint, will leave small specks of paint surrounding the area being painted. Also, these prior art nozzles provide only one type of spray pattern, such as the usual relatively broad pattern for completely covering an area being coated. These prior art nozzles do not permit various spray patterns to be achieved by the same nozzle.

Another problem with existing sprayers, especially paint sprayers, is the fixed nature thereof. In order to achieve satisfactory results with these existing sprayers, the viscosity of the paint has to be adjusted to a predetermined value. This requires the use of viscosity meters and the regulation of the viscosity of the paint by the addition of thinners in order for the sprayer to function satisfactorily since existing spray nozzles do not provide any type of satisfactory adjustment means to compensate for liquids or paints of different viscosities.

The closest known prior art to my present invention is that which is disclosed in a patent application filed in the Patent and Trademark Office on Oct. 26, 1981 and assigned Ser. No. 315,259, but which was subsequently abandoned. Although the three embodiments of the spray nozzle disclosed in the abandoned application satisfy needs and solve problems existing in the art, they do not achieve the objectives and advantages obtained by the spray nozzle of the present invention.

More specifically, the liquid spray nozzle adapter of the present invention can provide either a non-atomizing "lacing" spray pattern or the usual broad spray pattern for completely covering an area being coated, with the broad spray pattern being variable between the extremes of a low pressure, non-atomizing spatter and a high pressure, atomizing mist. In comparison, in a first embodiment shown in the abandoned application, the spray nozzle can only provide the lacing spray pattern, while in a second embodiment the spray nozzle can only produce the variable broad spray pattern. Although a third embodiment in the abandoned application discloses a spray nozzle which can achieve both the lacing and broad spray patterns, conversion of the spray nozzle between the patterns is inconvenient and messy. A rubber washer or the like must be inserted or removed from a component of the spray nozzle each time a broad or lacing spray pattern, respectively, is desired. Furthermore, the washers must be frequently replaced because of the degenerative effect that paint has on such washers. In addition, if the need exists for only a lacing spray pattern, only one of the two components of the improved spray nozzle need be purchased, with the purchaser having the option to buy the second component if the broad spray pattern is needed. However, in the third embodiment discussed above, both components of the spray nozzle must be purchased even if only the lacing spray pattern is needed.

Another advantage of the improved spray nozzle of the present invention over the spray nozzle disclosed in the previous abandoned application is that the nozzle of the present invention may be mounted on approximately 70% of existing spray guns without modification of the discharge control needle valve thereof. This feature is achieved by the improved design of the improved spray nozzle over the prior art nozzles described above, which are limited with respect to the number of different spray guns on which they may be mounted.

There is no liquid spray nozzle adapter for spray guns of which I am aware which provides a variety of spray patterns by simple adjustment or removal of a component of the spray nozzle, which eliminates or materially reduces the amount of atomization of the liquid during a spraying operation, which enables liquids of various viscosities to be sprayed without changing the viscosity of the liquid, and which is compatible with a majority of the spray guns now in existence.

DISCLOSURE OF THE INVENTION

Objectives of the invention include providing an improved liquid spray nozzle adapter which is removably mounted on the end of the barrel of a spray gun for providing various spray patterns of a particular liquid being sprayed from the gun by pressurized air; and in which the spray patterns can be a single, thin, ribbon-like stream which provides a decorative "lacing" effect, various spiral-like designs, a steady high-pressure stream which is advantageous for spraying insecticides or the like, and the usual broad area spray coating of the type provided by most spray nozzles, including broad high pressure mist and low pressure spatter patterns.

Another objective of the invention is to provide an improved nozzle adapter which materially reduces and in many applications eliminates the atomization of the liquid spray to avoid the small specks of dried material which heretofore adhered to surrounding fixtures and presented a maintenance and clean-up problem.

A further objective of the invention is to provide an improved nozzle adapter which is designed for compatibility with a majority of the spray guns presently in use without modification of the discharge control needles thereof.

Still another objective of the invention is to provide an improved nozzle adapter having two separate members which are adjustable with respect to each other, whereby a tubular-shaped stream of pressurized air is discharged concentrically about the liquid material discharge opening of the cone-shaped nozzle, which by adjusting the amount of air being discharged provides a variety of spray patterns and can substantially reduce or eliminate atomization of the paint; and in which the liquid material discharge member has a plurality of auxiliary pressurized air ports located rearwardly of the material discharge opening of the nozzle and adjacent to the base of the nozzle, whereby the discharge member is mounted on a spray gun without the air adjustment member attached thereto, and the liquid material is discharged in a fine stream which is carried to a surface by a plurality of pressurized air streams surrounding the nozzle discharge opening to provide a decorative "lacing" effect on the surface being treated.

A still further objective of the invention is to provide an improved nozzle adapter which enables liquids of various viscosities to be sprayed easily by adjusting the air discharge openings of the nozzle, in which the nozzle can be produced relatively inexpensively, which is free of moving parts, washers and other additional components which are subject to wear, breakage, repair and maintenance, and which is sturdy and durable in use and can be mounted on the end of usual types of spray guns presently being used in the paint spray industry.

These objectives and advantages of the invention are obtained by the nozzle adapter for a liquid material sprayer of the type having a material discharge control needle valve extending outwardly through a liquid material discharge passage formed in an end of the sprayer, and in which pressurized air inlet and outlet passages are formed in the end of the sprayer which are adapted to communicate with a source of pressurized air, said nozzle adapter including, in combination; a liquid material discharge member having a cone-shaped nozzle projecting outwardly forwardly from a front wall; an internal generally axially extending bore formed in the liquid material discharge member terminating in an outer liquid material discharge opening in the nozzle, said bore being adapted to communicate with the liquid material discharge passage of a sprayer when the discharge member is mounted on the sprayer; pressurized air opening means formed in the liquid material discharge member rearwardly of and extending coaxially about the outer liquid material discharge opening of the nozzle, said pressurized opening means being adapted to communicate with the pressurized air passages of the sprayer whereby the pressurized air is discharged from the discharge member rearwardly of the material discharge opening; a pressurized air adjustment member adjustably mounted on the liquid material discharge member for regulating the pressurized air opening means, said adjustment member having a generally flat front wall which extends generally transversely to the axis of the nozzle of the discharge member, said front wall having a rearwardly extending conical-shaped air passageway formed therein; and attachment means formed on the liquid material discharge member for removably attaching said discharge member on a sprayer and for removably attaching the pressurized air adjustment member on the discharge member, with the nozzle of said discharge member being located within and extending through the air passageway of the adjustment member and forming an annular pressurized air opening therebetween, with said annular air opening being coaxial with and rearwardly of the outer liquid material discharge opening of the nozzle.

BRIEF DESCRIPTION OF THE DRAWINGS

A preferred embodiment of the invention, illustrative of the best mode in which applicant has contemplated applying the principles, is set forth in the following description and is shown in the drawings and is particularly and distinctly pointed out and set forth in the appended claims.

FIG. 1 is a diagrammatic view of a liquid spray gun with the improved liquid spray nozzle adapter mounted thereon producing a broad spray pattern on a surface;

FIG. 2 is a left-hand end view and a rear view of a prior art liquid spray nozzle adapter;

FIG. 3 is a sectional view of another prior art nozzle adapter;

FIG. 4 is a sectional view of still another prior art nozzle adapter in assembled condition, showing the nozzle adapter with and without a washer inserted between its two main component parts;

Similar numerals refer to similar parts throughout the drawings.

BEST MODE FOR CARRYING OUT THE INVENTION

Figure 5:
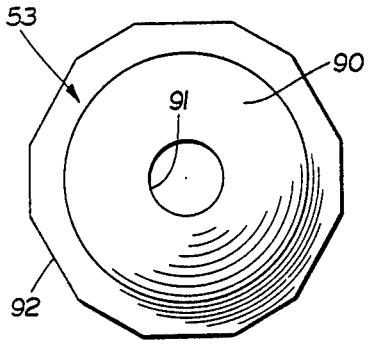
FIG. 5 is a front view of the pressurized air adjustment member of the nozzle adapter of the present invention.

Three embodiments of the closest known prior art to my improved liquid spray nozzle adapter of the present invention are shown in FIGS. 2 through 4. The structure, function, features and advantages of these prior art nozzle adapter embodiments were previously shown and discussed in a patent application Ser. No. 315,259, filed on Oct. 26, 1981, now abandoned.

A first embodiment of the prior art liquid spray nozzle adapter is indicated generally at 1, and is shown in detail in FIG. 2. Nozzle adapter 1 is a one-piece integral metal member having a cone-shaped nozzle 3 projecting outwardly forwardly from an annular-shaped end wall 4 which terminates in a hexagonal-shaped flange 5. Flange 5 is formed with a threaded cylindrical bore 6 for removably mounting nozzle adapter 1 on the end of a spray gun. The nozzle adapter is formed with an annular boss 7 which extends rearwardly in an opposite direction to that of cone-shaped nozzle 3 from the inside surface 8 of wall 4. Annular boss 7 surrounds a cylindrical chamber or bore 9 formed in the nozzle adapter which extends axially from surface 8 toward the outer end of nozzle 3. Chamber 9 communicates with a liquid material discharge opening 10 which is formed in the outer end of nozzle 3 through which the liquid material being sprayed is discharged. Annular wall 4 extends generally transversely with respect to the axis of nozzle opening 10 and chamber 9 which is common with the axis of the liquid material passage of a spray gun. A plurality of pressurized air discharge ports 11 are formed in and extend through end wall 4 and communicate with pressurized air passages of the spray gun.

Due to the particular arrangement of nozzle discharge opening 10 forwardly of the location of auxiliary air ports 11, nozzle adapter 1 will provide a thin ribbon-like spray pattern which is ejected from nozzle opening 10 by manipulation of the spray gun. The pressurized air streams emitted through air ports 11 will carry the liquid material discharge stream without substantial mixing therewith. This provides the "lacing" pattern effect. The thickness of the discharge stream can vary by varying the size of nozzle opening 10 or by changing the viscosity of the liquid being sprayed therefrom. Also, various other types of lacing patterns can be obtained by changing the number of air ports 11 or by changing the angles thereof in contrast to the coaxial directions of ports 11 as shown in FIG. 2. However, this particular embodiment of the prior art spray nozzle only provides the lacing spray pattern and will not produce the usual broad spray pattern provided by many spray nozzles.

A second embodiment of the prior art nozzle adapter is indicated generally at 13, and is shown in assembled operating condition in FIG. 3. Embodiment 13 is a two-piece construction having a liquid material discharge member 14 and a pressurized air adjustment member 15.

Liquid material discharge member 14 is an integral one-piece metal member having a material discharge nozzle 16 similar to nozzle 3 of the first embodiment. Nozzle 16 extends outwardly from an annular wall 17 which is surrounded by a cylindrical externally threaded wall 18 which terminates in a hexagonal-shaped, rearwardly extending flange 19 which has an internally threaded cylindical bore 20. Annular wall 17 extends transversely with respect to the longitudinal axis of nozzle 16. A cylindrical bore or liquid material discharge chamber 21, similar to chamber 9 of embodiment 1, is formed and extends coaxially along the hollow interior of nozzle 16 and terminates in a discharge opening 22. Chamber 21 communicates with the material discharge passage of a spray gun. A pair of diametrically opposed auxiliary air ports 23 are formed in and extend through annular wall 17 in a coaxial relationship with respect to central bore 21 and communicate with pressurized air passages in a spray gun when discharge member 14 is mounted thereon by the threaded engagement of flange bore 20 with the end of the spray gun.

Pressurized air adjustment member 15 is a one-piece metal member having an annular wall 24 with a hollow conical tip 25 projecting outwardly forwardly from the front surface of wall 24. Wall 24 extends transverse to the longitudinal axis of conical tip 25. A hexagonal-shaped flange 26 is formed integrally with annular wall 24 and extends rearwardly therefrom and is formed with a cylindrical, internally threaded bore 27. Conical tip 25 is formed with a bore 28 which terminates in an end opening 29. Air adjustment member 15 is threadably, adjustably mounted on discharge member 14 by the threaded engagement of internal bore threads 27 of member 15 with the external threads of cylindrical wall 18 of member 14.

Liquid material is discharged from discharge opening 22 of nozzle 16 and is carried forwardly toward the object being sprayed by a tubular-shaped, pressurized air stream which is discharged through the annular passage formed between the inner surface of conical tip 25 of adjustment member 15 and the outer surface of nozzle 16 of discharge member 14. The cylindrical or tubular stream of pressurized air is concentric with the stream of liquid material discharged from nozzle opening 22. Although this assembly produces a broad spray pattern for completely covering a surface being sprayed while reducing or eliminating atomization of the liquid, this particular embodiment of the prior art nozzle adapter does not provide the "lacing" spray pattern.

A third embodiment of the prior art nozzle adapter is indicated generally at 35 and is shown in assembled operating condition in FIG. 4. Embodiment 35 is a two-piece construction similar to embodiment 13 and consists of the liquid material discharge member 14 and a slightly modified pressurized air adjustment member 36. Pressurized air adjustment member 36 is a one-piece metal member and is very similar to adjustment member 15 of embodiment 13 (FIG. 3) except that a plurality of auxiliary pressurized air ports 37 are formed in an annular, transversely extending wall 38 at the base of a hollow conical tip 39. Wall 38 and conical tip 39 are similar to wall 24 and conical tip 25 of air adjustment member 15. The remaining features and construction of air adjustment member 36 are similar to those described above with respect to adjustment member 15 and therefore are not described in detail.

The addition of air ports 37 to air adjustment member 36 allow nozzle adapter embodiment 35 to combine the features of both nozzle embodiments 1 and 13. Air adjustment member 36 is moved rearwardly until conical tip 39 is abutted against nozzle 16 which will close the annular pressurized air discharge passage that is present in embodiment 13. In this position, the plurality of individually spaced pressurized air ports 37 provide the same operation and "lacing" pattern effect achieved by embodiment 1.

However, in order for adapter 35 to achieve the broad spray pattern effect achieved by embodiment 13 and by the nozzle adapter of the present invention, auxiliary air ports 37 must be blocked by insertion of a usual washer 40 as shown in the right-hand figure of prior art FIG. 4. After air ports 37 are blocked, air adjustment member 36 is adjusted to open the annular spacing between the inside surface of conical tip 39 and the outside surface of nozzle 16. Washer 40 is formed of a resilient material such as rubber and is therefore subject to degeneration as a result of its constant contact with the paint or other liquid material being discharged through the nozzle adapter. Thus, although embodiment 35 achieves the spray patterns of both adapters 1 and 13, the need exists in the art for a nozzle adapter which will achieve the various spray patterns without requiring insertion and removal of a washer which will eventually become worn and need replacing on a continual basis. Furthermore, the need exists in the art for a nozzle adapter which not only achieves all of the desired spray patterns but which is also adapted for use with a majority of the spray guns in use at the present time without requiring alteration of the discharge control needles thereof.

Figure 6:
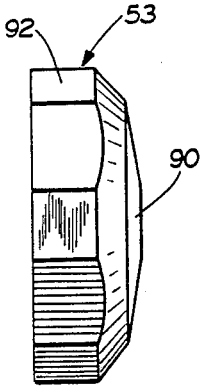
FIG. 6 is a left-hand end view of the air adjustment member shown in FIG. 5.
Figure 7:
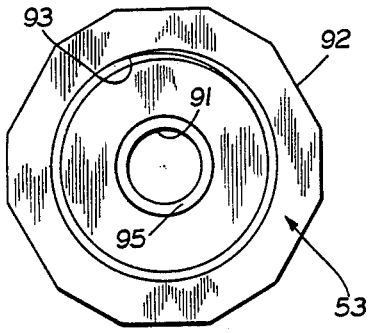
FIG. 7 is a rear view of the air adjustment member shown in FIGS. 5 and 6.
Figure 8:
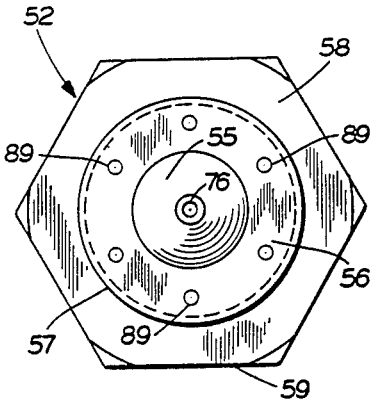
FIG. 8 is a front view of the liquid material discharge member of the nozzle adapter of the present invention.
Figure 9:
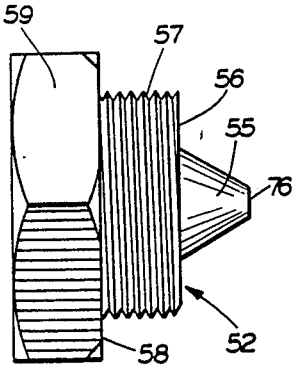
FIG. 9 is a left-hand end view of the discharge member shown in FIG. 8.
Figure 10:
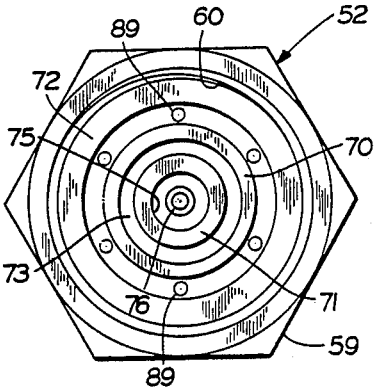
FIG. 10 is a rear view of the discharge member shown in FIGS. 8 and 9.

The improved liquid spray nozzle adapter of the present invention is indicated generally at 50, and is shown in detail in FIGS. 5 through 12, and is shown in FIG. 1 mounted on a usual spray gun, indicated generally at 51. Although the improved nozzle adapter is described and claimed as a liquid spray nozzle, its main use will be as a paint spray nozzle. However, its features and results can be used with and achieved with other liquids. Nozzle adapter 50 is a two-piece construction having a liquid material discharge nozzle member 52, which is shown in FIGS. 8, 9 and 10, and a pressurized air adjustment member 53, which is shown in FIGS. 5, 6 and 7.

Liquid material discharge member 52 is an integral one-piece metal member having a cone-shaped nozzle 55 projecting outwardly forwardly from an annular-shaped front wall 56 and is surrounded by a cylindrical externally threaded wall 57 which terminates in an annular shaped rearward wall 58 (FIGS. 8, 9 and 10). A hexagonal-shaped flange 59 which has an internally threaded cylindrical bore 60 extends rearwardly from rearward wall 58. Front wall 56 and rearward wall 58 preferably extend transversely with respect to the longitudinal axis of nozzle 55.

Figure 12:
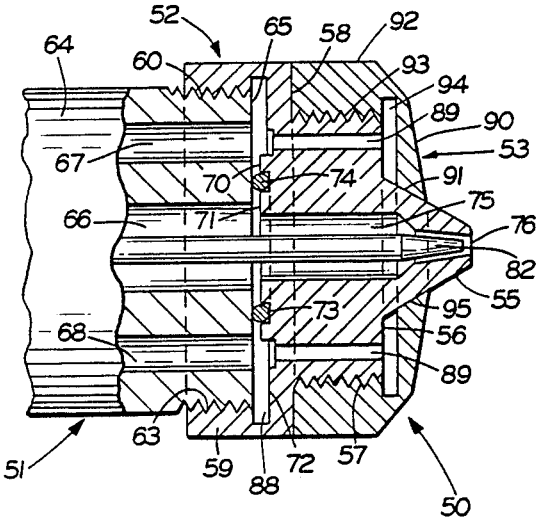
FIG. 12 is a fragmentary view, portions of which are broken away and in section, showing the two-piece nozzle adapter of FIG. 11 mounted on the end of a liquid spray gun.

Liquid material discharge member 52 is removably mounted on a threaded end 63 of a cylindrical barrel 64 of a spray gun 51 (FIGS. 1 and 12). Barrel 64 of the spray gun has a circular end face 65, and an axially extending liquid material discharge passage 66 is formed in barrel 64 and end face 65. A pressurized air inlet passage 67 is formed in barrel 64 and is spaced diametrically opposite of a pressurized air outlet passage 68. The construction of barrel 64 and the end configuration thereof is a type of construction being used in many spray guns currently being manufactured and is of the type with which the improved nozzle adapter is intended for use.

Figure 11:
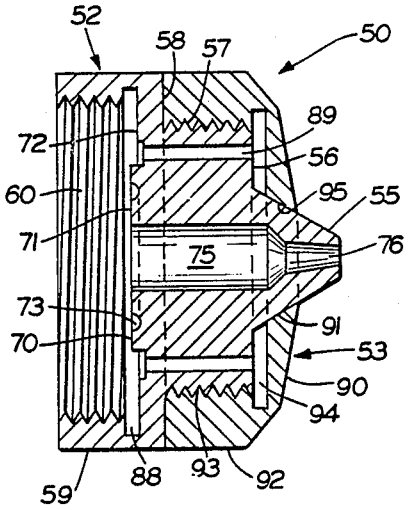
FIG. 11 is a sectional view of the two-piece nozzle adapter of FIGS. 5 through 10 in assembled condition.

Liquid material discharge member 52 of nozzle adapter 50 is formed with an first annular boss 70 and a second annular boss 71, each of which extends rearwardly in an opposite direction to that of cone-shaped nozzle 55 from the inside surface 72 of rearward wall 58, whereby a cylindrical groove 73 is formed therebetween (FIGS. 10, 11 and 12). An 0-ring 74 formed of a resilient material such as synthetic rubber or other elastomeric material is fitted in groove 73. Second annular boss 71 surrounds a cylindrical chamber or bore 75 formed in nozzle adapter 50 which extends axially from surface 72 toward the outer end of cone-shaped nozzle 55. Chamber 75 communicates with a liquid material discharge opening 76 which is formed in the outer end of nozzle 55 through which the liquid material being sprayed is discharged. Chamber 75 is common with the axis of liquid material passage 66 of spray gun 51.

FIG. 1 illustrates a usual type of paint spray gun on which the improved nozzle adapter is intended to be mounted. Spray gun 51 includes a pistol grip handle 80 and a pivotally mounted trigger 81 which controls the rate of discharge of the liquid material being sprayed therefrom by axial movement of a needle control valve 82 (FIG. 12) located within nozzle 55. A pressurized air line 83 is adapted to be attached to the rear of handle 80 and a liquid container 84 is removably mounted at the bottom end of a support member 85. A material discharge tube (not shown) extends from barrel 64 to adjacent the bottom of container 84 for drawing liquid material from container 84 and into and outwardly through liquid material discharge passage 66 of barrel 64. The pressurized air flowing through outlet passage 68 forces the liquid from container 84 and out of discharge passage 66. The above description of spray gun 51 is for illustrative purposes only, and the invention need not be limited to such a gun construction.

FIG. 12 illustrates improved nozzle adapter 50 mounted on barrel 64. 0-ring 74 of liquid material discharge member 52 is clamped against end face 65 of barrel 64 by threadably advancing flange 59 along threaded barrel end 63 until a tight fit is achieved therebetween. Mating end face 65 and resilient 0-ring 74 form an annular-shaped pressurized air chamber 88 between end face 65 of barrel 64 and inside surfaces 72 of rearward wall 58. Chamber 88 communicates with pressurized air passages 67 and 68 and with a plurality of pressurized air discharge ports 89 formed in and extending through annular front wall 56. Six air ports 89 are shown in discharge member 52 and preferably extend in a coaxial relationship with central nozzle bore 75 and are equally spaced about bore 75 in a circular configuration, as shown in FIGS. 8 and 10. Air ports 89 are shown as having a cylindrical configuration, but can have various configurations, such as elongated slots or the like, without affecting the concept of the invention.

Due to the particular mounting arrangement of nozzle discharge opening 76 forwardly of the location of auxiliary air ports 89, nozzle adapter 50 will provide a thin ribbon-like spray pattern (not shown) which is ejected from nozzle opening 76 when liquid material discharge member 52 is mounted on spray gun 51 and needle valve 82 thereof is retracted by trigger 81. The pressurized air streams emitted through air ports 89 will carry the liquid material discharge stream without substantial mixing therewith, thereby providing the "lacing" pattern effect. The thickness of the stream can vary by varying the size of nozzle opening 76 or by changing the viscosity of the liquid being sprayed therefrom. Also, various other types of lacing patterns can be obtained by changing the number of air ports 89 or by changing the angles thereof in contrast to the coaxial directions of ports 89, as shown in FIG. 12. It also has been discovered that the lacing effect is enhanced, when the liquid discharged is paint, by adding a coagulant to the paint. Such a coagulant assists the paint to remain in a thin stream for achieving the lacing effect.

In accordance with one of the main features of the present invention, there is no appreciable mixing of the pressurized air streams with the liquid material discharge stream due to the discharge stream nozzle opening 76 being appreciably forward with respect to the air stream discharge openings 89. In prior nozzle constructions, the liquid discharge opening was rearward of or at approximately the same location as the pressurized air openings. It is this particular relationship between the liquid material discharge opening 76 and pressurized air openings 89 which provides the lacing effect when liquid material discharge member 52 of present nozzle adapter 50 is mounted on a spray gun 51.

Pressurized air adjustment member 53 (FIGS. 5, 6 and 7) is a one-piece metal member having a generally flat front wall 90 with a rearwardly extending conical-shaped air passageway 91 formed therein, with wall 90 extending generally transverse to the longitudinal axis of air passageway 91. A hexagonal-shaped flange 92 is formed integrally with front wall 90 and extends rearwardly therefrom and is formed with a cylindrical, internally threaded bore 93.

Air adjustment member 53 is threadably, adjustably mounted on liquid discharge member 52 by the threaded engagement of internal bore threads 93 of member 53 with the external threads on cylindrical wall 57 of member 52, as shown in FIG. 11. When in assembled condition, the inside surface of front wall 90 of adjustment member 53 forms a second, generally annular-shaped pressurized air chamber 94 with front wall 56 of discharge member 52.

The operation of improved nozzle adapter 50 is best understood by referring to FIG. 12. Retraction of needle valve 82 will permit the liquid material to be discharged from nozzle discharge opening 76 of nozzle 55 which is carried forwardly toward the object being sprayed by a tubular-shaped, pressurized air stream which is discharged through the annular passage formed between the inner surface 95 (FIG. 7) of air passageway 91 of adjustment member 53 and the outer surface of cone-shaped nozzle 55 of material discharge member 52. The pressurized air from passage 67 flows into first annular pressurized air chamber 88, through auxiliary air ports 89 and into second annular pressurized air chamber 94. The air then flows through air passageway 91 and along the outer surface of cone-shaped nozzle 55 of discharge member 52. This cylindrical or tubular stream of pressurized air is concentric with the stream of liquid material discharged from nozzle opening 76. It has been found that such air and liquid streams materially reduce, and in many instances eliminate the atomization of the liquid, while still providing a broad spray pattern for completely covering a surface being sprayed. The desired amount of atomization is regulated by axial adjustment of adjustment member 53 on discharge member 52. Reduction or elimination of the atomization enables nozzle adapter 50 to be used in enclosed locations without providing protective coverings for adjacent furniture, fixtures, etc. Also, such non-atomization reduces the need for the operator to wear a protective mask or breathing apparatus.

It is believed that elimination of such atomization is achieved due to the tubular column of pressurized air surrounding the stream of liquid in addition to the liquid stream being discharged forwardly of the discharge location of the pressurized air, as when the liquid material discharge member is mounted on a spray gun 51 without having air adjustment member 53 attached thereto, as described above.

Another feature of nozzle adapter 50 is that the spray pattern and effect achieved thereby, as well as the degree of atomization, can be varied easily by adjusting the size of the pressurized air opening between cone-shaped nozzle 55 and inner surface 95 of members 52 and 53, respectively. Rotation of member 53 will move member 53 axially away from or toward member 52, thereby regulating the size of the annular pressurized air discharge opening between nozzle 55 and inner surface 95.

Thus, mounting liquid material discharge member 52 of improved nozzle adapter 50 on a spray gun 51, without mounting pressurized air adjustment member 53 on member 52, produces the "lacing" spray pattern which is also provided by prior art nozzle adapter embodiments 1 and 35 discussed above. However, embodiment 1 does not produce the broad spray pattern achieved by nozzle adapter 50 of the present invention as when the discharge member 52 and adjustment member 53 are mounted together on a spray gun. Furthermore, embodiment 13, although capable of producing a broad spray pattern, cannot provide a "lacing" pattern. Additionally, although embodiment 35 can produce both the "lacing" and broad spray patterns, as in nozzle adapter 50, embodiment 35 requires insertion and removal of a washer when broad and "lacing" spray patterns are desired, respectively. Such a procedure is inconvenient and messy, and the washer must frequently be replaced. In comparison, mere axial adjustment of adjustment member 53 on discharge member 52 allows nozzle adapter 50 to produce spray patterns ranging from a high pressure single stream of discharged liquid when member 53 is axially adjusted to its rearwardmost position thereby closing the annular pressurized air opening between inner surface 95 of member 53 and nozzle 55 of member 52, to a low pressure, spatter-like spray pattern when member 53 is adjusted axially outwardly whereby a large annular pressurized air opening is formed. Also, a high pressure, mist-like spray pattern is produced when member 52 is adjusted so that the annular pressurized air opening is very small. Innumerable other broad spray patterns are possible depending upon the axial position of adjustment member 53 relative to discharge member 52. In addition, improved nozzle adapter 50 is adapted for use on a greater number of existing spray guns than are embodiments 1, 13 and 35 because of the improved design of nozzle adapter 50, whereby many different types of discharge control needles are compatible with axially extending bore 75 of member 52.

Accordingly, the improved nozzle adapter is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved nozzle adapter is constructed and used, the characteristics of the construction, and the advantageous, new and useful results obtained; the new and useful structures, devices, elements, arrangements, parts, and combinations, are set forth in the appended claims.

What is claimed is:

1. A nozzle adapter for a liquid material sprayer of the type having a material discharge control needle valve extending outwardly through a liquid material discharge passage formed in an end of the sprayer, and in which pressurized air inlet and outlet passages are formed in the end of the sprayer which are adapted to communicate with a source of pressurized air, said nozzle adapter including, in combination:

(a) a unitary liquid material discharge member having a cone-shaped nozzle projecting outwardly forwardly from a front wall, said front wall extending generally transversely to a longitudinally extending axis of the nozzle;

(b) an internal generally axially extending bore formed in the liquid material discharge member terminating in an outer liquid material discharge opening in the nozzle, said bore being adapted to communicate with the liquid material discharge passage of a sprayer and to receive the material discharge control needle for selectively opening and closing the outer liquid material discharge opening of said discharge member when the discharge member is mounted on the sprayer;

(c) pressurized air opening means formed in the liquid material discharge member rearwardly of and extending coaxially about the outer liquid material discharge opening of the nozzle, said pressurized opening means being adapted to communicate with the pressurized air passages of the sprayer whereby the pressurized air is discharged from the discharge member rearwardly of the material discharge opening;

(d) a pressurized air adjustment member of one-piece construction adjustably mounted on the unitary liquid material discharge member for regulating the pressurized air opening means, said adjustment member having a generally flat front wall which extends generally transversely to the longitudinally extending axis of the nozzle of the discharge member, said front wall having only a single rearwardly extending conical-shaped air passageway formed therein;

(e) attachment means formed on the liquid material discharge member for removably attaching said discharge member on a sprayer and for removably attaching the pressurized air adjustment member on the discharge member, with the nozzle of said discharge member being located within and extending through the air passageway of the adjustment member and forming an annular pressurized air opening therebetween, with said annular air opening being coaxial with and rearwardly of the outer liquid material discharge opening of the nozzle; and (f) an elastomeric annular boss protruding from a rearward wall of the liquid material discharge member opposite to the direction of the nozzle and forming a first pressurized air chamber between the rearward wall of said discharge member and the end of a sprayer when the discharge member is mounted on the sprayer end.

2. The nozzle adapter defined in claim 1 in which the cross section of the axially extending bore of the liquid material discharge member is greater than the cross section of the discharge control needle.

3. The nozzle adapter defined in claim 1 in which the pressurized air opening means includes a plurality of holes formed in the front wall of the liquid material discharge member and spaced about the base of the nozzle.

4. The nozzle adapter defined in claim 1 in which the attachment means for attaching the liquid material discharge member on a sprayer is an internally threaded cylindrical flange extending rearwardly and opposite to the direction of the nozzle.

5. The nozzle adapter defined in claim 4 in which the cylindrical flange extends rearwardly from the rearward wall of the liquid material discharge member; and in which the rearward wall extends generally parallel to and is located rearwardly of the front wall of the discharge member.

6. The nozzle adapter defined in claim 5 in which the attachment means for attaching the pressurized air adjustment member on the liquid material discharge member is an externally threaded cylindrical wall which extends outwardly forwardly from the rearward wall to the front wall of the liquid material discharge member.

7. The nozzle adapter defined in claim 6 in which the pressurized air adjustment member has an internally threaded cylindrical flange extending rearwardly from the front wall; and in which said internally threaded cylindrical flange threadably engages the externally threaded cylindrical wall of the liquid material discharge member.

8. The nozzle adapter defined in claim 1 in which the area of the annular pressurized air opening is adjustable by axially adjusting the pressurized air adjustment member on the liquid material discharge member.

9. The nozzle adapter defined in claim 1 in which the first pressurized air chamber communicates with the pressurized air opening means and the pressurized air passages of the sprayer when the discharge member is mounted on the sprayer.

10. The nozzle adapter defined in claim 1 in which the front wall of the pressurized air adjustment member and the front wall of the liquid material discharge member form a second pressurized air chamber therebetween which communicates with the pressurized air opening means and the annular pressurized air opening formed between the air passageway of the air adjustment member and the nozzle of the discharge member.

* * * * *